US006577048B2

(12) United States Patent
Lee

(10) Patent No.: US 6,577,048 B2
(45) Date of Patent: Jun. 10, 2003

(54) INNER SHIELD FOR COLOR CRT

(75) Inventor: Ho Do Lee, Gimhae (KR)

(73) Assignee: LG Electronics Inc., Seoul (KR)

( * ) Notice: Subject to any disclaimer, the term of this patent is extended or adjusted under 35 U.S.C. 154(b) by 56 days.

(21) Appl. No.: 09/969,828

(22) Filed: Oct. 4, 2001

(65) Prior Publication Data

US 2002/0109450 A1 Aug. 15, 2002

(30) Foreign Application Priority Data

Dec. 15, 2000 (KR) ..... 2000-76816

(51) Int. Cl.[7] ..... H01J 29/06
(52) U.S. Cl. ..... 313/402; 313/479
(58) Field of Search ..... 313/432–438, 313/440, 402, 477 R, 479, 442; 445/30, 37

(56) References Cited

U.S. PATENT DOCUMENTS 5,103,132 A * 4/1992 Van Der Bolt et al. ..... 313/402
5,530,316 A * 6/1996 Haga et al. ..... 313/479
5,763,990 A * 6/1998 Kwak ..... 313/402
5,804,912 A * 9/1998 Park ..... 313/402
6,310,433 B1 * 10/2001 Youn et al. ..... 313/402
6,448,702 B1 * 9/2002 Kamada et al. ..... 313/402

* cited by examiner

*Primary Examiner*—Michael H. Day
*Assistant Examiner*—Anthony Perry
(74) *Attorney, Agent, or Firm*—Birch, Stewart, Kolasch & Birch, LLP

(57) ABSTRACT

A color CRT having an inner shield being mounted at a frame inside a panel and a funnel to shield an earth magnetic field, in which the inner shield comprises: a vertical portion formed in parallel to the central axis of the CRT and mounted at the frame, a slope portion extended slanted against the central axis of the CRT at a rear side of the vertical portion and a notch with its central portion formed concave at the end portion of the slope portion, the opposite of the frame; and on the assumption that the entire height of the inner shield constructed with the vertical portion and the slope portion is 'V', a height ($V_1$) of the vertical portion satisfies the relational expression of $0.18 \leqq V_1/V \leqq 0.25$, and on the assumption that the shortest height from a starting point of the vertical portion to the notch is $V_2$, the height $V_1$ of the vertical portion satisfies a relational expression of $0.40 \leqq V_1/V_2 \leqq 0.54$. By reducing the variation degree that the electron beam is landed is according to the external magnetic field variation, when an image is reproduced, a color spread phenomenon due to a color mixture is prevented from occurring. In addition, since the color spread phenomenon due to a color mixture is prevented, the inner shield contributes to obtain a high image quality, and thus, a reliability of its product is improved.

5 Claims, 4 Drawing Sheets

INNER SHIELD FOR COLOR CRT

BACKGROUND OF THE INVENTION

1. Field of the Invention

The present invention relates to a color CRT, and more particularly, to an inner shield of a color CRT that is capable of improving a shielding effect by enhancing a structure of an inner shield and capable of preventing a color spread phenomenon due to color mixture when an image is reproduced by reducing a variation degree in landing of an electron beam according to an external magnetic field variation according to the improved shielding effect.

2. Description of the Background Art

FIG. 1 is a partially-cut side view showing an internal construction of a color CRT having an inner shield in accordance with a conventional art, and FIGS. 2A and 2B are a rear view and a plan view showing the inner shield in accordance with the conventional art.

As shown in FIG. 1, a color CRT is formed with its external appearance by a panel 10 coated with a red, green and blue color fluorescent material 11 on the inner face thereof, and a funnel 20 sealed at the rear side of the panel 10 by a frit glass and maintaining an internal pressure in a high vacuum state of about 10–7 Torr.

A shadow mask 40 having fine slits serving for color selection is mounted at the inner side of the panel 10 through the medium of a frame 30, and the frame 30 is supported at the inner face of the panel 10 by means of the spring 50.

An inner shield 60 for shielding a magnetic field such as an earth magnetic field so that an electron beam 71 injected from an electron gun 80 is not influenced by the magnetic field is mounted at a rear side of the frame 30.

A neck portion 70 is installed at a rear side of the funnel 20, and the electron gun 80 for injecting the electron beam 71 is mounted at an inner side of the neck portion 70.

A deflection yoke 90 for deflecting the electron beam 71 injected from the electron gun 80 to the entire fluorescent surface coated with the fluorescent material 11 is mounted at a boundary portion positioned between the rear side of the funnel 20 and the neck portion 70.

Reference numeral 25 denotes a safety band for reinforcing the coupling portion of the panel 10 and the funnel 20.

Accordingly, when the electron gun 80 irradiates the electron beam 71, the electron beam 71 passes through holes 41 formed at the shadow mask 40 and collides with the fluorescent material 11 formed at the inner surface of the panel 10, radiating the fluorescent material 11, and according, an image is reproduced through the panel 10.

Especially, the inner shield 60 includes a vertical portion 62 extended in parallel to a tube central axis (X) and a slope portion 63 integrally formed at the rear portion of the vertical portion 62 and extended to be sloped toward the tube central axis (X).

As shown in FIG. 1, a front opening (Bf) is formed in front of the vertical portion 62, and a bent portion is formed bent vertically to the vertical portion 62 so that the inner shield 60 can be fixed with a clip (C) to the frame 30.

A rear opening (Br) relatively smaller than the front opening (Bf) is formed at a rear side of the slope portion 63.

The inner shield 60 of a color CRT of the conventional art, however, has several problems.

That is, for example, with reference to FIG. 2B, since the height (h1) of the vertical portion 62 is too small for the entire height (H) of the inner shield 60 constituted by the vertical portion 62 and the slope portion 63, the slope portion 63 is away from the funnel 20 with the big distance (d) therebetween, resulting in that efficiency in shielding the earth magnetic field is degraded.

In case where the inner shield 60 is adopted to a product of a color CRT and used for some periods, since the shielding efficiency of the earth magnetic field is degraded, the variation degree that the electron beam is landed becomes great according to the variation of an external magnetic field, causing a problem of occurrence of a color spread due to a color mixture when an image is reproduced.

When the color spread occurs due to such factors, the product of the color is CRT purchasing a high image quality is devaluated, and a reliability of the product is accordingly degraded.

SUMMARY OF THE INVENTION

Therefore, an object of the present invention is to provide an inner shield of a color CRT that is capable of improving a shielding effect by enhancing a structure of an inner shield and capable of preventing a color spread phenomenon due to color mixture when an image is reproduced by reducing a variation degree in landing of an electron beam according to an external magnetic field variation according to the improved shielding effect.

To achieve these and other advantages and in accordance with the purpose of the present invention, as embodied and broadly described herein, there is provided a color CRT having an inner shield being mounted at a frame inside a panel and a funnel to shield an earth magnetic field, the inner shield having a vertical portion formed in parallel to the central axis of the CRT and mounted at the frame, a slope portion extended slanted against the central axis of the CRT at a rear side of the vertical portion and a notch with its central portion formed concave at the end portion of the slope portion, the opposite of the frame, and under the assumption that the entire height of the inner shield constructed with the vertical portion and the slope portion is 'V', a height ($V_1$) of the vertical portion satisfies the relational expression of $0.18 \leqq V_1/V \leqq 0.25$, and on the assumption that the shortest height from a starting point of the vertical portion to the notch is $V_2$, the height $V_1$ of the vertical portion satisfies a relational expression of $0.40 \leqq V_1/V_2 \leqq 0.54$.

On the assumption that a sectional area of a front opening formed by the vertical portion, the frame side, is 'Af' and a sectional area of a rear opening formed by the slope portion, the opposite side of the frame, is 'Ar', the inner shield is designed to satisfy a relational expression of $0.56 \leqq Ar/Af \leqq 0.78$.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A plurality of embodiments of a color CRT may exist, of which the most preferred embodiment will now be described.

Figure 1:
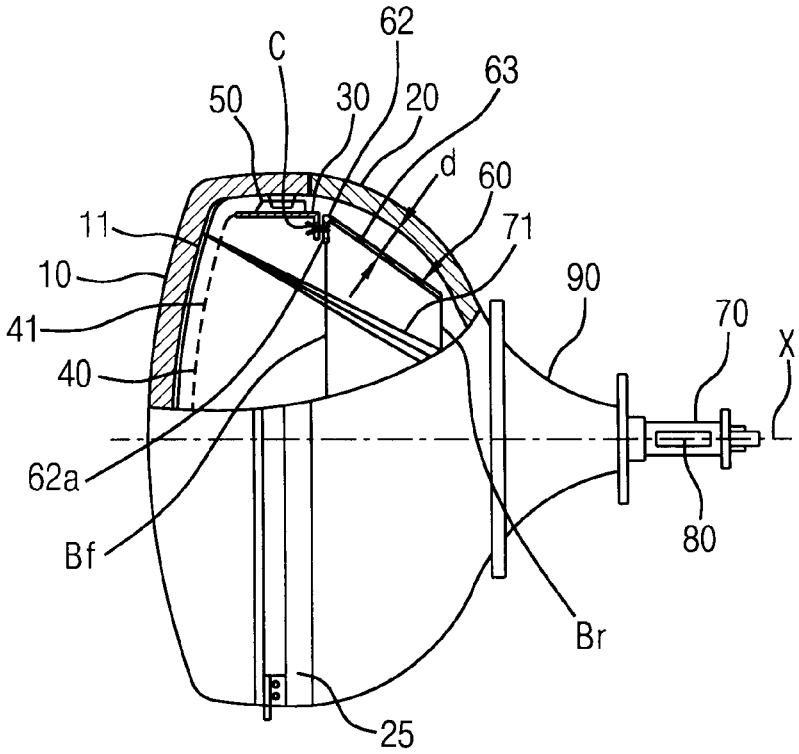
FIG. 1 CONVENTIONAL ART
FIG. 1 is a partially cut side view showing the inner construction of a color CRT having an inner shield in accordance with a conventional art.
Figure 2A:
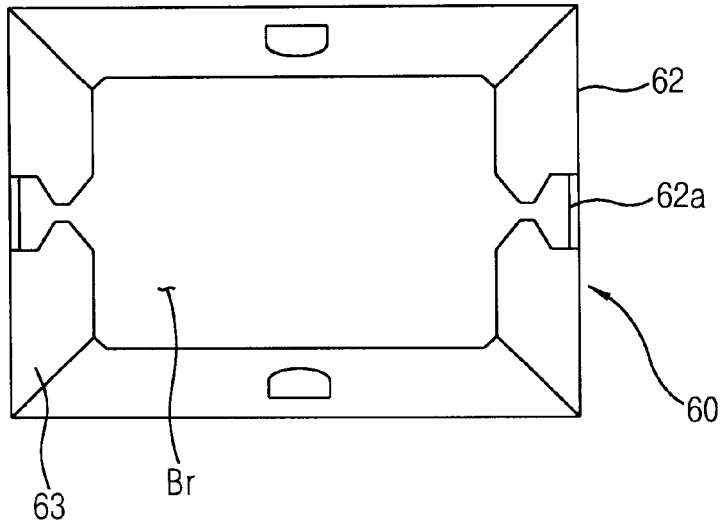
FIG. 2A CONVENTIONAL ART
FIGS. 2A and 2B are a rear view and a plan view showing the inner shield in accordance with the conventional art.
Figure 2B:
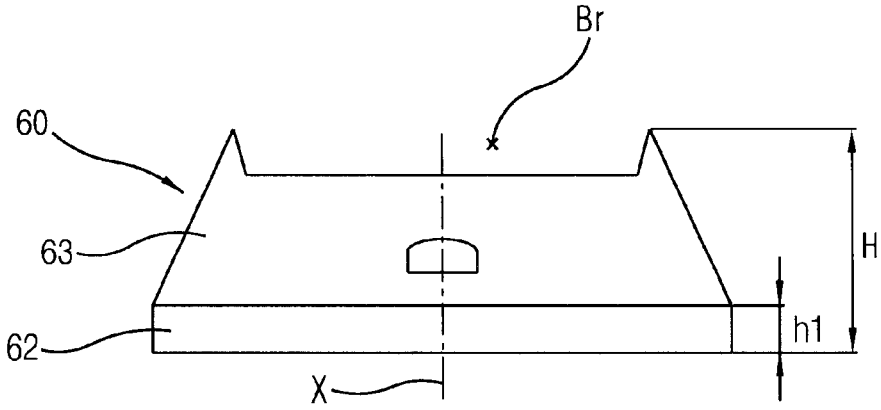
FIG. 2B CONVENTIONAL ART
Figure 3:
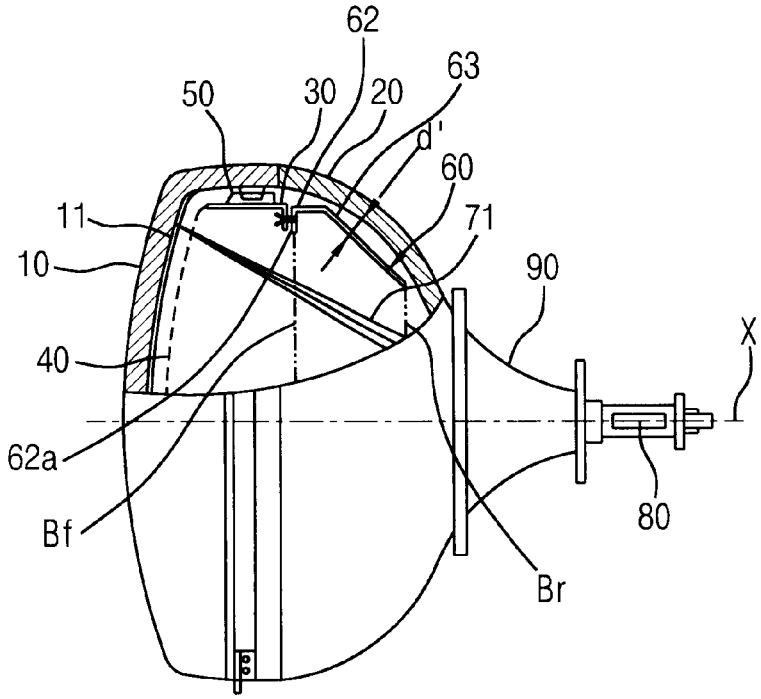
FIG. 3 is a partially cut side view showing a color CRT having an inner shield in accordance with a preferred embodiment of the present invention.

FIG. 3 is a partially cut side view showing a color CRT having an inner shield in accordance with a preferred embodiment of the present invention.

Figure 4A:
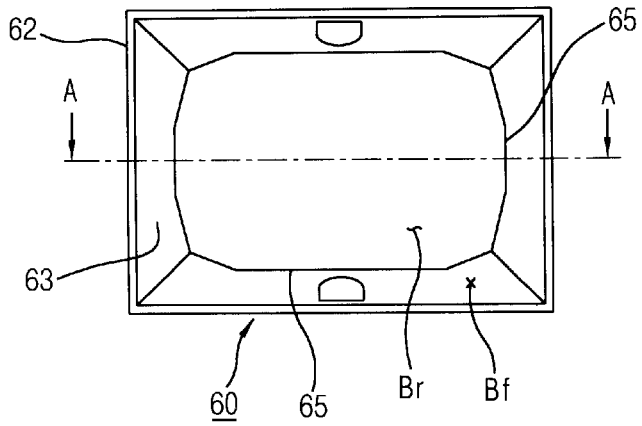
FIGS. 4A and 4B are a front view and a rear view showing the inner shield of a color CRT in accordance with the preferred embodiment of the present invention.
Figure 4B:
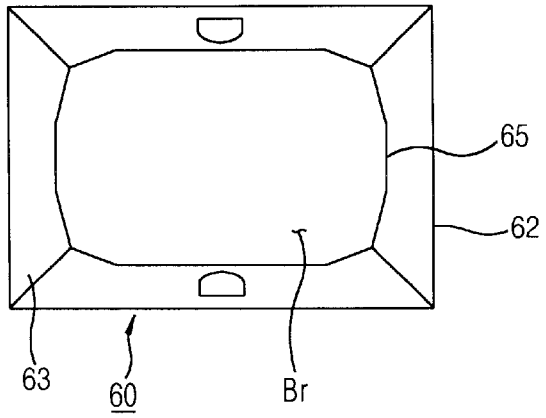
Figure 5:
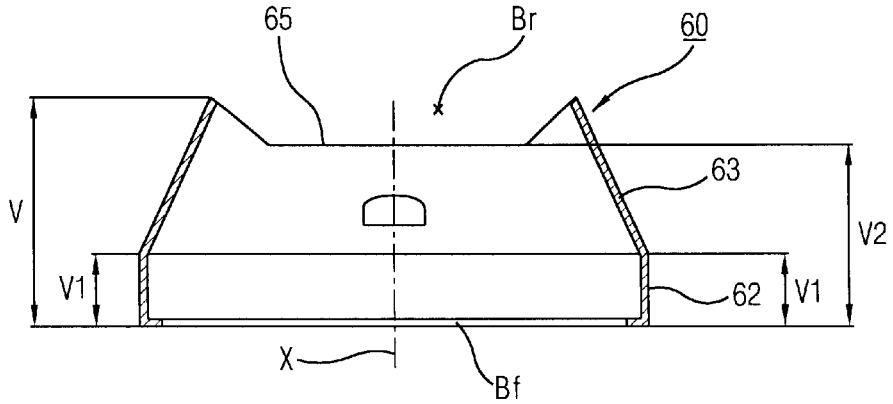
FIG. 5 is a sectional view taking along line A—A of FIG. 4 in accordance with the preferred embodiment of the present invention.

FIGS. 4A and 4B are a front view and a rear view showing the inner shield of a color CRT in accordance with the preferred embodiment of the present invention, and FIG. 5 is a sectional view taking along line A—A of FIG. 4 in accordance with the preferred embodiment of the present invention.

Same reference numerals of the present invention are given to the same elements as those of the conventional art.

The inner shield 60 of the present invention includes a vertical portion 62 extended in parallel to the tube central axis (X) as shown in FIG. 5 and a slope portion 63 extended slanted toward the tube central axis (X) at a rear side of the vertical portion 62.

Especially, the vertical portion 62 and the slope portion 63 of the inner shield 60 are designed in the following conditions.

On the assumption that an entire height of the inner shield having the vertical portion 62 and the slope portion 63 is 'V', a height ($V_1$) of the vertical portion 62 accounts for 18~25% of the entire height (V).

The reason for setting the height of the vertical portion 62 is because if the height $V_1$ of the vertical portion 62 accounts for more than 25% of the entire height (V), the slope portion 63 comes too near the inner wall of the funnel 20, causing problems that the a mask is clogged due to an inserted graphite separation during a fabrication process the workability is degraded.

Conversely, if the height ($V_1$) of the vertical portion 62 accounts for below 18% of the entire height (V), the height (V1) of the vertical portion 62 is so low that the slope portion 63 of the inner shield 60 is much distanced from the inner face of the funnel 20, causing a problem that the degaussing effect is sharply degraded.

A notch 65 is formed at the rear end portion of the slope portion 63, of which the central portion is concave. With reference to FIG. 5, assuming that the shortest height of the notch from the front portion of the vertical portion 62 to the notch 65 is $V_2$, the height $V_1$ of the vertical portion 62 is designed to account for 40~54% of the shortest height $V_2$ of the notch.

The notch 65 of the slope portion 63 includes a short side portion in the vertical direction and a long side portion in the horizontal direction. Such a designing can be selectively adopted according to a position where a getter is mounted.

The reason why the vertical portion 62 is designed to have the height V1 to account for 40~54% of the shortest height V2 of the notch is that if the height V1 of the vertical portion 62 is below 40% of the shortest height V2 of the notch, influence of an external magnetism is sharply increased to occur a landing error.

Meanwhile, if the height V1 of the vertical portion 62 is above 54% of the shortest height V2 of the notch, a uniform scattering is not performed in gattering, so that a vacuum degree is degraded.

The inner shield 60 is designed to satisfy a relational expression of $0.56 \leqq Ar/Af \leqq 0.78$ when the sectional area (Ar) of the rear opening (Br) formed at the slope portion 63, the opposite side of the frame 30, is compared with the sectional area (Af) of the front opening (Bf) formed at the vertical portion 62, the frame side.

The reason for designing the front and the rear openings Br and Bf is that if Ar/Af is below 0.56, not only does an interference occur in a beam deflection path but also the slope portion 63 of the inner shield 60 is too much distanced from the inner face of the funnel 20, causing a problem that the degaussing effect is rapidly degraded.

Meanwhile, if Ar/Af is above 0.78, the slope portion 63 of the inner shield 60 comes too close to the inner face of the funnel 20, causing problems that the mask is clogged due to the inserted graphite separation and workability is degraded. In addition, since the space between the beam and the inner shield 60 is increased, so that an influence of the external magnetism is sharply increased and thus a landing error occurs.

Accordingly, when the inner shield 60 fabricated to satisfy the conditions is adopted to a color CRT, as shown in FIG. 3, the space d' between the inner shield 60 and the funnel 20 is reduced compared to the case of adopting the inner shield of the conventional art. The reason for this is that the funnel 20 becomes narrow with a steep slope with a certain portion at a portion corresponding to the marginal portion of the vertical portion 62 and the slope portion 63 of the inner shield 60.

Table 1 below comparatively shows a beam landing variation amount and magnetic field redundancy of a sample adopting the improved inner shield of the present invention and the inner shield product according to the conventional art.

TABLE 1

| | Conventional inner shield | Inner shield of the present invention |
|---|---|---|
| Beam landing variation amount | 45 μm | 10 μm |
| Magnetic field redundancy | 0.8 G | 2 G |

As shown in Table 1, notably, the inner shield of the present invention exhibits an excellent effect compared to that of the conventional inner shield.

As so far described, the inner shield of the color CRT of the present invention has many advantages.

That is, for example, by reducing the variation degree that the electron beam is landed according to the external magnetic field variation, when an image is reproduced, a color spread phenomenon due to a color mixture is prevented from occurring.

In addition, since the color spread phenomenon due to a color mixture is prevented, the inner shield contributes to obtain a high image quality, and thus, a reliability of its product is improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A color CRT having an inner shield being mounted at a frame inside a panel and a funnel to shield an earth magnetic field, wherein the inner shield comprises: a vertical portion formed in parallel to the central axis of the CRT and mounted at the frame, a slope portion extended slanted against the central axis of the CRT at a rear side of the vertical portion and a notch with its central portion formed concave at the end portion of the slope portion, the opposite of the frame; and on the assumption that the entire height of the inner shield constructed with the vertical portion and the slope portion is 'V', a height ($V_1$) of the vertical portion satisfies the relational expression of $0.18 \leqq V_1/V \leqq 0.25$, and on the assumption that the shortest height from a starting point of the vertical portion to the notch is $V_2$, the height $V_1$ of the vertical portion satisfies a relational expression of $0.40 \leqq V_1/V_2 \leqq 0.54$.

2. A color CRT having an inner shield being mounted at a frame inside a panel and a funnel to shield an earth magnetic field, wherein the inner shield comprises: a vertical portion formed in parallel to the central axis of the CRT and mounted at the frame, and a slope portion extended slanted against the central axis of the CRT at a rear side of the vertical, and on the assumption that the entire height of the inner shield constructed with the vertical portion and the slope portion is 'V', a height ($V_1$) of the vertical portion satisfies the relational expression of $0.18 \leqq V_1/V \leqq 0.25$.

3. The color CRT of claim 2, wherein on the assumption that a sectional area of a front opening formed by the vertical portion, the frame side, is 'Af' and a sectional area of a rear opening formed by the slope portion, the opposite side of the frame, is 'Ar', the inner shield is designed to satisfy a relational expression of $0.56 \leqq Ar/Af \leqq 0.78$.

4. A color CRT having an inner shield being mounted at a frame inside a panel and a funnel to shield an earth magnetic field, wherein the inner shield comprises: a vertical portion formed in parallel to the central axis of the CRT and mounted at the frame, a slope portion extended slanted against the central axis of the CRT at a rear side of the vertical portion and a notch with its central portion formed concave at the end portion of the slope portion, the opposite of the frame; and on the assumption that the shortest height from a starting point of the vertical portion to the notch is $V_2$, the height $V_1$, of the vertical portion satisfies a relational expression of $0.40 \leqq V_1/V_2 \leqq 0.54$.

5. The color CRT of claim 4, wherein on the assumption that a sectional area of a front opening formed by the vertical portion, the frame side, is 'Af' and a sectional area of a rear opening formed by the slope portion, the opposite side of the frame, is 'Ar', the inner shield is designed to satisfy a relational expression of $0.56 \leqq Ar/Af \leqq 0.78$.

* * * * *